US006732740B2

(12) United States Patent
Schumacher

(10) Patent No.: US 6,732,740 B2
(45) Date of Patent: May 11, 2004

(54) METHOD OF MAKING A TOBACCO ROD WITH EMBEDDED ADDITIVE

(75) Inventor: Peter Schumacher, Hamburg (DE)

(73) Assignee: Hauni Maschinenbau AG, Hamburg (DE)

( * ) Notice: Subject to any disclaimer, the term of this patent is extended or adjusted under 35 U.S.C. 154(b) by 0 days.

(21) Appl. No.: 10/323,910

(22) Filed: Dec. 20, 2002

(65) Prior Publication Data

US 2003/0106561 A1 Jun. 12, 2003

Related U.S. Application Data

(62) Division of application No. 09/459,917, filed on Dec. 14, 1999, now Pat. No. 6,516,809.

(30) Foreign Application Priority Data

Dec. 14, 1998 (DE) ..... 198 57 296

(51) Int. Cl.[7] ..... A24C 5/06

(52) U.S. Cl. ..... 131/79; 131/31; 131/84.3; 131/84.4; 131/309; 131/84.2

(58) Field of Search ..... 131/31, 62, 79, 131/84.2, 84.4, 300, 309, 280, 290

(56) References Cited

U.S. PATENT DOCUMENTS 3,550,598 A 12/1970 McGlumphy
4,409,995 A 10/1983 Nichols
4,703,764 A 11/1987 Marquardt et al.
4,721,119 A 1/1988 Ludszeweit et al.
4,893,640 A 1/1990 Heitmann et al.
4,986,285 A 1/1991 Radzio et al.
4,993,434 A 2/1991 Haws et al.
5,072,742 A 12/1991 Heitmann
5,135,008 A 8/1992 Oesterling et al.
6,516,809 B1 * 2/2003 Schumacher ..... 131/79

FOREIGN PATENT DOCUMENTS

WO WO 98/36650 8/1998

* cited by examiner

*Primary Examiner*—Dionne A. Walls
(74) *Attorney, Agent, or Firm*—Venable LLP; Robert Kinberg; Chad C. Anderson

(57) ABSTRACT

The filler of a cigarette rod has a tubular portion made of shredded tobacco and surrounding at least one row of spherical inserts made of aromatic material or aerosol. The tubular portion is made by feeding tobacco shreds against the underside of the horizontal lower reach of a foraminous conveyor belt advancing beneath a suction chamber to accumulate a first layer of shreds. The inserts are delivered to the underside of the first layer and are attracted thereto by suction. A second layer of shredded tobacco is assembled by showering shreds against the underside of the first layer where the second layer underlies the spherical inserts. The thus obtained filler is draped into a web of wrapping material to form a cigarette rod ready to be subdivided into sections of unit or multiple unit length. The spherical inserts are expelled from a revolving receptacle under the action of centrifugal force to form a row which is conveyed toward the underside of and advances with the first layer.

15 Claims, 5 Drawing Sheets

METHOD OF MAKING A TOBACCO ROD WITH EMBEDDED ADDITIVE

CROSS-REFERENCE TO RELATED CASES

This application is a divisional application of U.S. application Ser. No. 09/459,917, filed Dec. 14, 1999 now U.S. Pat. No. 6,516,809, and claims the priority of German patent application Serial No. 198 57 296.4 filed Dec. 14, 1998. The disclosure of the German patent application, as well as that of each US and foreign patent and patent application mentioned in the specification of the present application, is incorporated herein by reference.

BACKGROUND OF THE INVENTION

The present invention relates to improvements in methods of and apparatus for making rod-shaped articles of the tobacco processing industry. Such articles include plain and filter cigarettes, cigars, cigarillos and analogous smokers' products. More particularly, the invention relates to improvements in methods of and apparatus for making a continuous rod wherein a tubular wrapper of cigarette paper or the like surrounds a rod-like filler consisting at least in part of a smokable material. Still more particularly, the invention relates to improvements in methods of and in apparatus for making a continuous rod wherein a tubular wrapper surrounds a rod-like filler containing comminuted smokable material (such as shreds or other fragments of natural, reconstituted and/or substitute tobacco) as well as one or more additives. Typical examples of rod-shaped smokers' products which can be made in accordance with the method of and in the apparatus of the present invention are plain or filter cigarettes and, therefore, the following disclosure will refer primarily to the making of a rod which can be divided into plain cigarettes; however, it is to be understood that the improved method and apparatus can be resorted to with equal or similar advantage in connection with the making of all or practically all other rod-shaped smokers' products.

It is already known to contact a rod-like filler of tobacco with an additive prior to draping of the filler into a web of cigarette paper or other suitable wrapping material, i.e., prior to completion of the making of a cigarette rod which is ready to advance through a suitable severing device (known as cutoff) which repeatedly cuts across the leader of the advancing cigarette rod to thus form a file of plain cigarettes of unit length or multiple unit length. Plain cigarettes of unit length are or can be transported directly to a packing machine. Plain cigarettes of multiple unit length are transported to a so-called tipping machine which serves to turn out filter cigarettes.

The aforementioned additive is or can be a liquid additive which is sprayed onto or otherwise contacted with the running rod-like filler of shredded and/or otherwise comminuted natural, reconstituted and/or artificial tobacco. As a rule, a liquid additive can constitute an aerosol or an aromatic substance such as menthol. If the additive is a volatile substance, it is preferably caused to contact the smokable material shortly or immediately prior to draping of the filler into cigarette paper or other suitable wrapping material; this reduces the likelihood of evaporation of high percentages of such substances.

It is also known to make the smokable constituent (i.e the fibrous filler or the fibrous part of the filler) of two or more combustible smoke-generating constituents. Reference may be had, for example, to commonly owned U.S. Pat. No. 4,703,764 granted Nov. 3, 1987 to Siegfrid Marquardt et al.

for "METHOD AND APPARATUS FOR MAKING ROD-LIKE FILLERS FROM SEVERAL TYPES OF FIBROUS MATERIAL".

OBJECTS OF THE INVENTION

An object of the invention is to provide a novel and improved method of introducing into the smokable part of a rod-like filler for the making of cigarette rods or the like one or more additives in such a way that each additive is uniformly distributed from end to end of each individual cigarette or an analogous rod-shaped smokers' product embodying a portion of the filler.

Another object of the invention is to provide a novel and improved method of introducing volatile additives into a rod-like filler which is to form part of a cigarette rod or the like.

A further object of the invention is to prevent evaporation of volatile additives (such as one or more aerosols and/or aromatic substances) prior to confinement of a rod-like filler, which contains such additive(s), in a wrapper of cigarette paper or the like.

An additional object of the invention is to provide a method which renders it possible to alter the quantities of one or more additives per unit length of a rod-like filler which is to form part of a continuous cigarette rod or the like.

Still another object of the invention is to provide a method which exhibits the above-enumerated advantages but can be practiced by resorting to relatively simple and inexpensive yet reliable apparatus.

A further object of the invention is to provide the apparatus with novel and improved means for manipulating volatile additives which are to influence the characteristics (such as aroma) of rod-shaped smokers' products.

Another object of the invention is to provide the above outlined apparatus with novel and improved means for feeding and manipulating the combustible tobacco smoke generating constituents of a cigarette rod filler in a plurality of stages preparatory and subsequent to introduction of one or more volatile additives.

An additional object of the invention is to provide the apparatus with novel and improved means for manipulating encapsulated volatile additives.

Still another object of the invention is to provide a cigarette rod making machine which embodies one or more apparatus of the above outlined character.

A further object of the invention is to provide an apparatus which is constructed and assembled in such a way that it can reliably confine evaporable liquid additives by guaranteeing that those characteristics of the rod-shaped smokers' products which are attributable to the presence of one or more additives remain at least substantially unchanged irrespective of the duration of storage prior to actual lighting of the products.

Another object of the invention is to provide rod-shaped smokers' products which are produced in accordance with the above outlined method.

A further object of the invention is to provide the above outlined apparatus with novel and improved means for manipulating spherical capsules for evaporable additives prior to confinement in comminuted smokable material.

SUMMARY OF THE INVENTION

One feature of the present invention resides in the provision of a method of making a smokable filler, e.g., a filler which is ready to be draped into a web of cigarette paper or other suitable wrapping material and to be thus converted into a cigarette rod adapted to be subdivided into plain cigarettes of unit length or multiple unit length.

The improved method comprises the steps of building a first flow (e.g., a relatively thin layer) of a smokable first particulate material and advancing the first flow lengthwise in a predetermined direction along a predetermined path wherein the flow has a side which is accessible in a first (upstream) and in a second (downstream) portion of the predetermined path, delivering to the aforementioned side of the advancing first flow particles of a second particulate material in the first (upstream) portion of the predetermined path, applying to the aforementioned side of the advancing first flow a second flow (e.g., a relatively thin layer) containing the first material (i.e., a material which is smokable) and overlying the particles of the second material (the applying step is carried out in the aforementioned second (downstream) portion of the predetermined path), and converting the first and second flows (and the particles of second material between such flows) into a rod-like filler wherein the particles of second material are at least substantially surrounded by the first material.

The first particulate material contains (or can contain) comminuted tobacco, e.g., shredded natural tobacco leaves, shredded and/or otherwise comminuted sheets of reconstituted tobacco and/or fragments of artificial tobacco.

The second particulate material can consist of or contains aromatic substances and/or aerosols. It is presently preferred to employ a second material in the form of spheres or analogous configurations (e.g., lenses, tablets or the like).

The delivering step can include introducing into the first portion of the predetermined path metered quantities of second particulate material per unit length of the rod-like filler, per unit length of the first flow, or per unit of time (e.g., when the first flow is being advanced at a constant speed).

In accordance with a presently preferred embodiment, the delivering step can include gathering particles of second particulate material into at least one series (such as an elongated file or row) of advancing particles, and admitting into the first (upstream) portion of the predetermined path successive particles of the at least one series. The just mentioned gathering step can include establishing an accumulation of second particles (i.e., particles of second particulate material) in random distribution (such as in a pile or heap), subjecting the accumulation to the action of centrifugal force to thus propel particles of second particulate material into a substantially circular path, and conveying particles of second particulate material along the substantially circular path toward and into the first (upstream) portion of the predetermined path. The conveying step can include maintaining the particles of second particulate material in an at least substantially horizontal plane. The just described embodiment of the improved method preferably further comprises the step of at least intermittently replenishing the accumulation of such particles to thus maintain the quantity of particles in the accumulation above a predetermined threshold value.

The advancing step can comprise maintaining the first flow in a state of suspension by suction (e.g., at the underside of the horizontal lower reach of an endless foraminous belt which travels along the open underside of a stationary suction chamber). The aforementioned side of the first flow is then the underside of the pneumatically (suctionally) suspended first flow. The delivering step then preferably comprises attracting the particles of second material to the underside of the first flow by suction (i.e., by the expedient of maintaining the first flow in suspended condition), so that the particles of second material share the movement of the first flow along the predetermined path.

Another feature of the present invention resides in the provision of an apparatus for making a smokable filler. The apparatus comprises means for building a first flow (such as a relatively thin and relatively narrow layer) of a smokable first particulate (e.g., shredded) material including means for advancing the first flow lengthwise in a predetermined direction along a predetermined path wherein the first flow has a side which is accessible in a first (upstream) as well as in a second (downstream) portion of the predetermined path, means for delivering to the aforementioned side of the advancing first flow particles of a second particulate material in the first (upstream) portion of the predetermined path, means for applying to the aforementioned side of the advancing first flow a second flow (e.g., a second relatively thin and relatively narrow layer) containing the first or an equivalent material and overlying the particles of the second material (the applying means is arranged to supply particles of second material into the second (downstream) portion of the predetermined path), and means for converting the first and second flows (as well as the particles of second material between the two flows) into a rod-like filler wherein the second material is at least substantially surrounded by the first material.

The first material can contain shredded and/or otherwise comminuted tobacco leaf laminae, fragments of tobacco ribs, fragments of sheets of reconstituted tobacco and/or fragments of artificial tobacco.

The delivering means can comprise a suitable receptacle for an accumulation of particles of second material in random distribution, means for conveying at least one series (such as a file or a row) of particles of second material along a second path extending to the first (upstream) portion of the predetermined path, and means for transferring particles of second material from the receptacle into the second path. The transferring means of such apparatus can comprise means for converting a portion of the accumulation of particles of second material in the receptacle into successive increments of the at least one series of particles of second material. The second path can constitute or resemble an at least substantially circular path, and the converting means can comprise means for circulating the accumulation in the receptacle about a predetermined axis to thus subject at least the aforementioned portion of the accumulation to the action of centrifugal force with attendant entry of particles of second material into the second path. The circulating means can comprise means for rotating the receptacle and the particles of second material in the receptacle about an at least substantially vertical axis. The receptacle has at least one outlet for particles of second material, and such at least one outlet is normally remote from the at least substantially vertical axis and is arranged to receive particles of second material under the action of centrifugal force and to admit the thus received particles of second material into at least one inlet of the second path.

The conveying means can be provided with discrete pockets (such as tooth spaces in the marginal portion of a spur gear) for particles of second material.

The receptacle is or can be arranged to rotate about an at least substantially vertical axis and can include a circular bottom wall and an annular sidewall diverging radially of the vertical axis and downwardly toward the bottom wall. The receptacle is provided with at least one outlet for the particles of second material, and such at least one outlet is provided between the bottom wall and the sidewall. For example, the outlet can constitute an arcuate slot. It is preferred to provide the receptacle with an annular array of discrete outlets for particles of second material between a marginal portion of the bottom wall and a bottom portion of the sidewall. At least some of the outlets preferably have elliptical outlines and the major axes of such elliptical outlines are or can be at least substantially tangential to the bottom wall of the receptacle.

It is often preferred to employ in the improved apparatus transferring means which comprises a rotary circular disc having a marginal portion including alternating teeth and tooth spaces. The tooth spaces provide outlets for admission of particles of second material into the second path. The receptacle is rotatable about an at last substantially vertical axis and includes a bottom wall adjacent and located above the disc. The second path extends from the marginal portion of the disc to the first (upstream) portion of the predetermined path. Such apparatus can further comprise a first guide which is located below the disc and a second guide which surrounds the disc and defines with the first guide a means for confining particles of second material in the tooth spaces during a predetermined stage of advancement of particles of the second type with the disc. The guides are preferably stationary and flank the tooth spaces in the direction of the axis of rotation of the disc.

The radius of the bottom wall of the receptacle is or can be smaller than the radius of the disc, and the disc is preferably rotatable about a second axis which is spaced apart from and parallel to the rotational axis of the receptacle. The at least one outlet of the receptacle is arranged to admit particles of second material from the accumulation in the receptacle into the tooth spaces of the disc, and such tooth spaces serve to convey particles of second material from the at least one outlet of the receptacle to the first (upstream) portion of the predetermined path.

The improved apparatus can further comprise means for rotating the receptacle at a first speed, and the advancing means can be arranged to advance the first flow along the predetermined path at a second speed which at least approximates the first speed. Still further, the improved apparatus can comprise means for rotating the receptacle and the disc at different speeds or for rotating the receptacle and the disc at speeds which at least closely approximate each other.

If the first flow is a layer of tobacco shreds having first and second marginal portions which are or can be equidistant (i.e., parallel) to each other, the delivering means can include means for supplying to the aforementioned side of the first flow (layer) particles of second material at least substantially midway between the marginal portions of the first flow.

The delivering means can include means for introducing into the predetermined path metered quantities of particles of second material per unit length of the first flow.

As already mentioned hereinabove, the particles of second material can constitute or resemble spheres. This is often desirable for convenience of mass production of such commodities as well as because such particles can be readily manipulated in the improved apparatus, e.g., to form one or more rows which are advanced lengthwise toward the first (upstream) portion of the predetermined path for convenient and highly predictable introduction into the predetermined path. Moreover, spherical particles or second material can be readily manipulated in order to ensure that each and every successive unit length of the filler can contain identical numbers of particles of second material, i.e., identical percetages of volatile and/or other substances (such as menthol) in each of a short or long series of unit lengths of the finished filler.

The novel features which are considered as characteristic of the invention are set forth in particular in the appended claims. The improved apparatus itself, however, both as to is costruction and the modes of making, assembling and manipulating the same, together with numerous additional important and advantageous features and attributes thereof, will be best understood upon perusal of the following detailed description of certain presently preferred specific embodiments with reference to the accompanying drawings.

DESCRIPTION OF PREFERRED EMBODIMENTS

Figure 1:
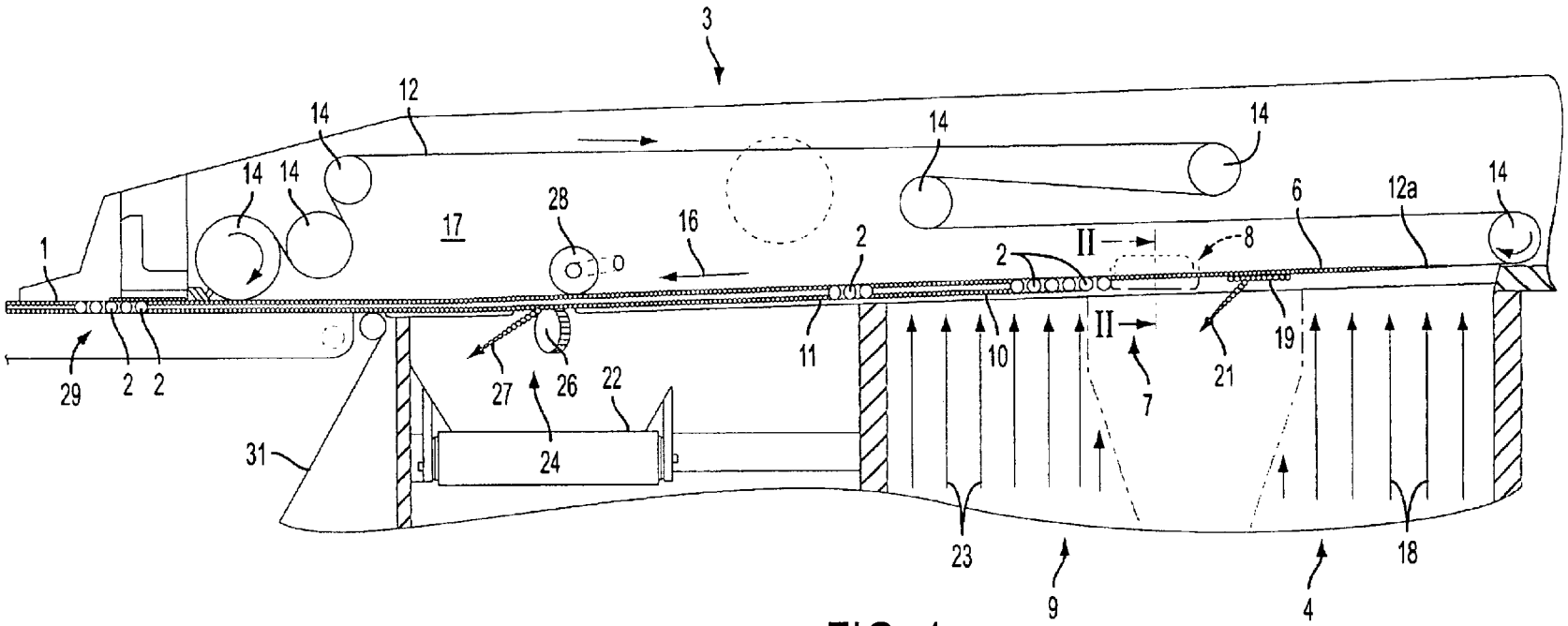
FIG. 1 is a fragmentary schematic partly elevational and partly vertical sectional view of an apparatus which embodies one form of the invention and wherein the second particulate material is delivered into the rod making unit in the form of a row of spheres shown greatly enlarged for the sake of clarity.

FIGS. 1 to 6 illustrate the relevant details of an apparatus 3 which embodies one presently preferred form of the invention and is designed to turn out a continuous cigarette rod 1 wherein a tubular wrapper (converted cigarette paper strip or web 31) surrounds an at least substantially cylindrical rod-shaped filler 11 including a tube composed of two converted flows or layers 6, 10 and a core composed of a row of preferably spherical particles 2 containing at least one additive, e.g., a volatile aromatic substance and/or an aerosol. Each of the flows 6 and 10 can contain or consist of a smokable particulate material such as shredded particles of natural, reconstituted and/or artificial tobacco. The particulate material of the flow 6 may but need not be the same as that of the flow 10.

The finished cigarette rod 1 is advanced lengthwise (to the left, as viewed in FIG. 1) beyond a customary wrapping unit 29 (wherein the cigarette paper web 31 is draped around the rod-like filler 11) and through a standard cutoff (not shown) which severs the leader of the advancing rod 1 at regular intervals to thus produce a continuous file of rod-shaped articles of unit length or multiple unit length. The articles of unit length can constitute plain cigarettes, cigars or cigarillos which are normally conveyed through one or more testing stations prior to being delivered into storage (defective articles are segregated from satisfactory articles at or downstream of the testing station) or directly into a packing machine. The packing machine can turn out soft or hinged lid packets containing arrays of e.g. four, ten or twenty cigarettes. Alternatively, discrete rod-shaped articles can be fed into a tipping machine where such articles are united with filter rod sections of unit length or multiple unit length to form filter cigarettes, cigarillos or cigars. The manner in which pairs of plain cigarettes of unit length are assembled with discrete filter mouth-pieces of double unit length to form filter cigarettes of double unit length (which are thereupon severed to yield pairs of filter cigarettes of unit length) is fully described and shown in commonly owned U.S. Pat. No. 5,135,008 granted Aug. 4, 1992 to Erwin Oesterling et al. for "METHOD OF AND APPARATUS FOR MAKING FILTER CIGARETTES". The patented apparatus comprises numerous units, devices and assemblies which can be employed in the apparatus of the present invention, for example, to convert webs or strips into tubular wrappers, to test rod-shaped articles, to splice webs end-to-end, and many others. The same holds true for the aforementioned commonly owned '764 patent to Marquardt et al.

The diameters of the spherical particles 2 shown in FIGS. 1 to 4 (in comparison with the parts adjacent thereto) are greatly exaggerated for the sake of clarity. In reality, the particles 2 are microcapsules made of a suitable (e.g., porous) carrier material which can retain a minute quantity of a liquid additive, or of a nonporous material which constitutes a minute vessel for a small, very small or minuscule body of liquid additive. The porous material can be partially or fully impregnated with a liquid additive which is released on lighting of the smoker's product having a rod-like filler containing a given number of particles 2.

It has been found that the particles 2 can be manipulated quite satisfactorily if they constitute or resemble spheres with a diameter of between about 0.5 and 1 mm. However, the utilization of spherical particles 2 with diameters at least slightly outside of the above range is equally within the purview of the present invention. Menthol is one of presently popular additives which can be introduced into the fillers of cigarettes or other rod-shaped smokers' products. It has been found that an additive which is introduced into and confined in the filler of a cigarette in accordance with the method of and in the apparatus of the present invention can be stored for extended periods of time, i.e., that prolonged storage does not adversely affect or eliminate those qualities which are expected from a cigarette, cigar or cigarillo due to the presence of the additive(s).

The apparatus 3 of FIG. 1 comprises a flow building unit 4 which is arranged to build the flow or layer 6 consisting of shredded (first) particles, e.g., comminuted tobacco leaf laminae in admixture to comminuted tobacco ribs and/or other smokable materials. The flow 6 is caused to grow to full size (width and depth) at the underside of the lower reach or stretch 12*a* of an endless foraminous conveyor belt 12 which is trained over several pulleys or sheaves 14. At least one of the pulleys 14 is driven to advance the lower reach 12*a* in the direction indicated by an arrow 16. The lower reach 12*a* of the foraminous belt 12 constitutes the moving bottom wall of a stationary suction chamber 17 which attracts tobacco shreds to the underside of the lower reach 12*a* while the latter advances above an upright duct forming part of the flow building unit 4 and receiving tobacco shreds from a suitable distributor (also called hopper) cooperating with the unit 4 and supplying shreds of tobacco in the direction indicated by arrows 18. Distributors or hoppers are shown in the aforementioned '764 patent to Marquardt et al. as well as in numerus other U.S. patents owned by the assignee of the present application. Reference may be had, for example, to U.S. Pat. No. 4,893,640 granted Jan. 16, 1990 to Uwe Heitmann et al. for "MULTIPLE-ROD CIGARETTE MAKING MACHINE" as well as to U.S. Pat. No. 5,072,742 granted Dec. 17, 1991 to Uwe Heitmann for "METHOD OF AND APPARATUS FOR MAKING A FILLER OF SMOKABLE MATERIAL".

The lower reach 12*a* of the endless foraminous belt 12 defines an elongated preferably at least substantially horizontal path wherein the fully grown flow 6 advances beyond the flow building unit 4 toward, through and beyond a trimming or equalizing device 19 serving to remove the surplus 21 of shredded tobacco at the underside of the flow 6. The thus smoothed underside of the equalized flow 6 advances through a path portion 8 where it is contacted by at least one preferably continuous file or row of spherical particles 2 in such a way that the deposited particles are located at least substantially midway between the two longitudinally extending marginal portions of the flow 6. The particles 2 are attracted to the underside of the trimmed flow 6 and advance with the latter in the direction indicated by the arrow 16 due to subatmospheric pressure (suction) prevailing in the chamber 17. Thus, the suction chamber 17 performs several functions including attracting the growing and thereafter the fully grown flow 6 to the underside of the lower reach 12*a* as well as of attracting preferably metered quantities of particulate second material 2 to the trimmed underside of the flow 6. The particulate material 2 is caused to enter the portion 8 of the path at the underside of the lower reach 12*a* by advancing along an arcuate second path 7 in a novel manner which will be fully described hereinafter.

Successive increments of the flow 6 and of the row or rows of particles 2 at the underside of the lower reach 12*a* thereupon enter and advance through a unit 9 which builds the second flow or layer 10 in such a way that the flow 10 underlies the underside of the flow 6 and thus confines the particles 2 between the two flows. The material of the flow 10 is or can be the same as the material of the flow 6. Such material (e.g., shredded natural, reconstituted and/or artificial tobacco) is supplied in the direction indicated by the arrows 23 and is attracted to the underside of the flow 6 by suction prevailing in the chamber 17. It is clear that at least one of the layers or flows 6, 10 can be formed by propelling shredded tobacco through the duct of the unit 4 and/or 9 and toward the underside of the lower reach 12*a* of the driven endless belt 12.

The widths of the flows 6 and 10 are determined by two stationary sidewalls 13, 13*a* (see FIGS. 2 and 3) which extend in the direction indicated by the arrow 16 and define an elongated narrow channel 32 adjacent the underside and extending lengthwise of the lower reach 12*a* of the foraminous bet 12. The channel 32 directs the removed (by 19) surplus 21 of shredded tobacco onto a belt conveyor 22 which returns the thus collected surplus 21 of the material of the flow 6 into the distributor of the apparatus 3. Suitable distributors are described and shown in the aforementioned commonly owned U.S. patents of the assignee. The unit 4 can be a distributor or hopper known as VE and available at the assigneee of the present application. Distributors of the type VE are utilized in or with rod making machines known as PROTOS and utilized for the making of cigarettes all over the world.

Successive increments of the freshly formed flow 6 are equalized by the trimming device 19 which removes the surplus 21. The thus obtained trimmed flow is a relatively thin layer which advances in the channel 32 and has a width determined by the transverse distance between the sidewalls 13 and 13*a*. The unit 9 supplies smokable particles in the direction indicated by the arrows 23 to build the second layer or flow 10 which is attracted to the underside of the trimmed flow 6 by the suction chamber 17. The flows 6, 10 and the particles 2 between them constitute the filler 11 which is entrained (in the direction indicated by the arrow 16) by the lower reach 12*a* of the endless belt 12. The filler 11 is trimmed by an equalizing device 24 which removes the surplus 27 from the underside of the flow 10. Such surplus is removed by two rotary clamping discs (not shown) in co-operation with a rotary paddle wheel or brush 26.

The removed surplus 27 is intercepted by the belt conveyor 22 which returns it into the distributor unit 4. An equalizing device which can be utilized at 24 to remove the surplus 27 is disclosed in the aforementioned '764 patent to Marquardt et al. A vertically adjustable roller 28 (e.g., an idler roller) is installed in the suction chamber 17 at a level above the surplus removing member 26 to determine the quantity of surplus 27 being removed by the trimming device 24.

A wrapping mechanism which can be utilized at 29 to drape the web 31 around the filler 11 advancing with the lower reach 12*a* of the foraminous belt 12 beyond the trimming device 24 is disclosed in commonly owned U.S. Pat. No. 4,721,119 granted Jan. 26, 1988 to Dieter Ludszeweit et al. for "ROD MAKING MACHINE WITH MEANS FOR ADJUSTING THE POSITION OF WRAPPING MATERIAL". Such mechanisms are known as formats.

The mechanism 29 is followed by the aforementioned cutoff (not shown) which can be of the type described and shown in commonly owned U.S. Pat. No. 4,986,285 granted Jan. 22, 1991 to Andrzej Radzio et al. for "METHOD AND APPARATUS FOR ASCERTAINING THE DENSITY OF WRAPPED TOBACCO FILLERS AND THE LIKE". The thus obtained rod-shaped smokers' products of unit length or multiple unit length are thereupon processed (e.g., in a packing machine or in a filter tipping machine) in a manner not forming part of the present invention.

The manner in which the spherical particles 2 are manipulated ahead of and during transport to the underside of the flow 6 along the arcuate second path 7 is illustrated in FIGS. 2 to 6. That portion of the first path (defined by the lower reach 12*a* of the foraminous conveyor 12) which receives particles 2 from the path 7 is shown at 8 (see FIG. 1). The path 7 has an outlet which discharges successive particles 2 of the row 61 (FIGS. 4 and 5) of such particles into the channel 32 between the sidewalls 13, 13*a* at the underside of the lower reach 12*a*. Such outlet is located at the underside of the already trimmed (at 19) first layer or flow 6 which is pneumatically attracted to and advances with the underside of the lower reach 12*a*. The means for evacuating air from the suction chamber 17 can comprise a fan or the like, not shown.

The path 7 is defined by a particle delivering unit 33 which cooperates with or includes a conveying unit 34. The latter serves to transfer particles 2 from a receptacle 36 of the delivering unit 33 into the path 7. The receptacle 36 is rotatable about a preferably vertical axis 41 and includes a circular horizontal bottom wall 37 as well as an inverted cup-shaped upper part having an annular wall 38 which diverges radially outwardly and downwardly toward the upper side of the bottom wall 37. The radially outermost (marginal) portion of the bottom wall 37 is provided with an annular array of outlets 39 which are adjacent the internal surface of the lower portion of the annular wall 38 (see particularly FIG. 6). In accordance with a presently preferred embodiment, the outlets 39 have particle-admitting inlet portions with oval outlines. The major axes of such outlines are tangential to the marginal portion of the bottom wall 37. The particle discharging ends of the outlets 39 have substantially circular outlines. In other words, the outlets 39 are bounded by substantially funnel-shaped surfaces which facilitates evacuation of spherical particles 2 from the interior of the receptacle 36 into the outlets 39 as well as the advancement of such particles from the oval receiving portions toward and beyond the circular discharging portions of the outlets 39. The lower part of the wall 38 of the receptacle 36 is provided with an external ring gear 42 (see particularly FIGS. 2 and 3) which mates with a pinion 44 (shown by broken lines in FIGS. 2, 5 and 6) receiving torque from a prime mover 43 (e.g., a variable-speed electric motor) which is shown by broken lines in FIG. 2. It is clear that the just described means (42–44) for rotating the wall 38 constitutes but one of numerous means which can be utilized to rotate the receptacle 36 about the vertical axis 41. For example, one can resort to a toothed belt and pinion drive.

The conveying unit 34 comprises a disc 46 having a marginal portion composed of spur gear teeth 47 alternating with tooth spaces 48. The dimensions of the tooth spaces 48 are such that they permit spherical particles 2 to pass therethrough on their way from the outlets 39 into an arcuate passage defined by the disc 46 with two stationary guides 57, 58. The disc 46 is located immediately or closely beneath the bottom wall 37 of the receptacle 36. That part of the disc 46 which is not overlapped by the bottom wall 37 is overlapped by a stationary cover plate or lid 59. The disc 46 is rotatable about a vertical axis 49 (i.e., about an axis parallel to the rotational axis 41 of the receptacle 36) by the prime mover 43 through the medium of a toothed belt transmission 51 or in any other suitable way. The RPM of the receptacle 36 is synchronized with that of the disc 46.

The improved apparatus 3 further comprises means for ensuring that the supply in the pile or batch of randomly distributed particles 2 in the receptacle 36 remains above a predetermined minimum or threshold value. Such means comprises a reservoir 52 having a spout 53, a chute or another suitable outlet serving to discharge particles 2 from the reservoir 52 into the receptacle 36. When the prime mover 43 rotates the receptacle 36 about the vertical axis 41, the particles 2 in the interior of such receptacle are acted upon by centrifugal force which propels them against the downwardly and outwardly diverging internal surface of the wall 38. The particles 2 descend along such internal surface into the outlets 39 (see FIG. 3). Such particles are held in the outlets 39 by the upper side of the disc 46 which is closely adjacent the underside of the bottom wall 37. The afore-described funnel-shaped surfaces bounding the outlets 39 contribute to predictable entry of particles 2 into, and to their retention in, the outlets 39.

Figure 2:
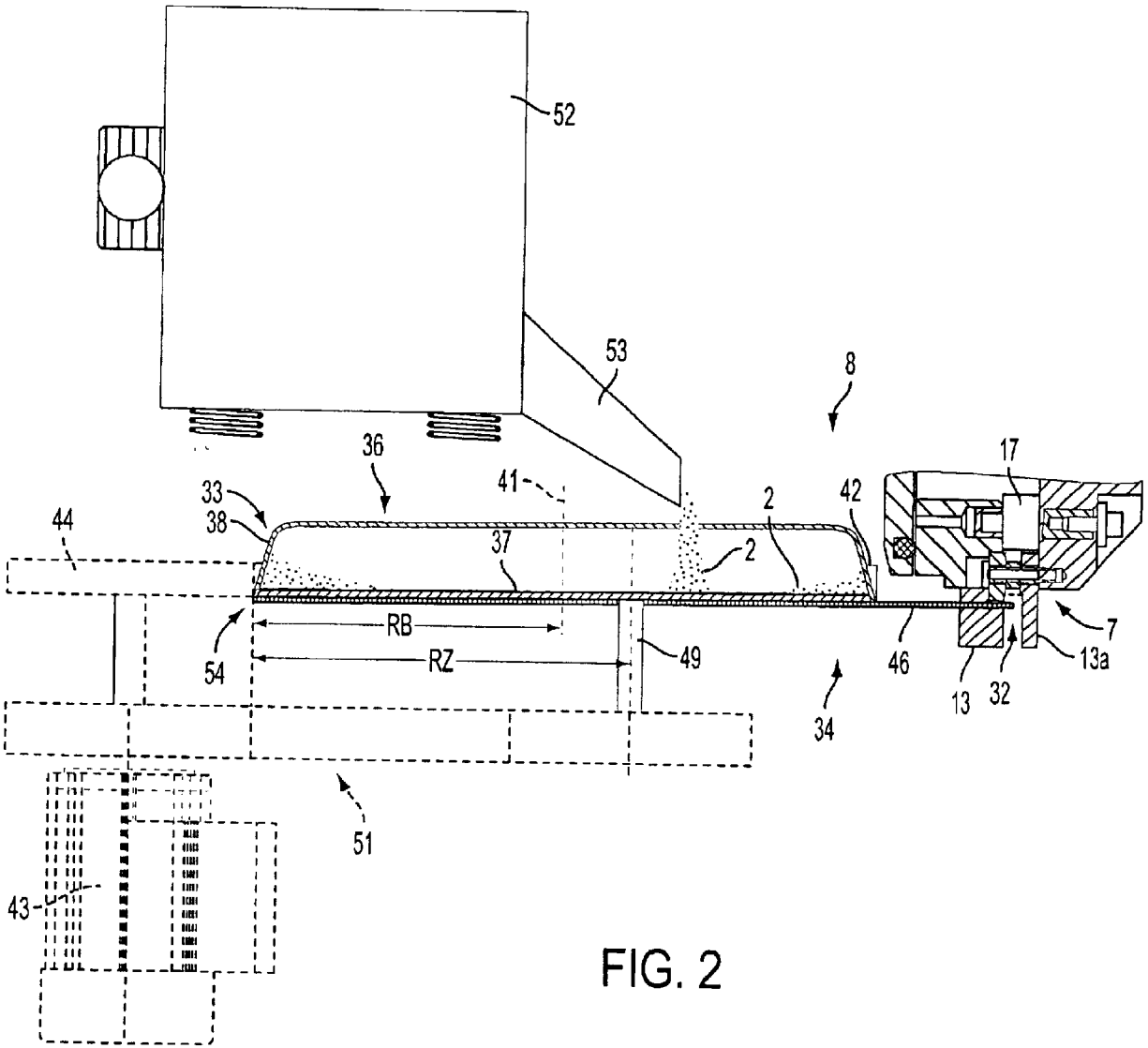
FIG. 2 is a partly elevational and partly vertical sectional view substantially as seen in the direction of arrows from the line II—II of FIG. 1 and illustrates certain details of the means for delivering second particulate material to the rod forming unit.
Figure 3:
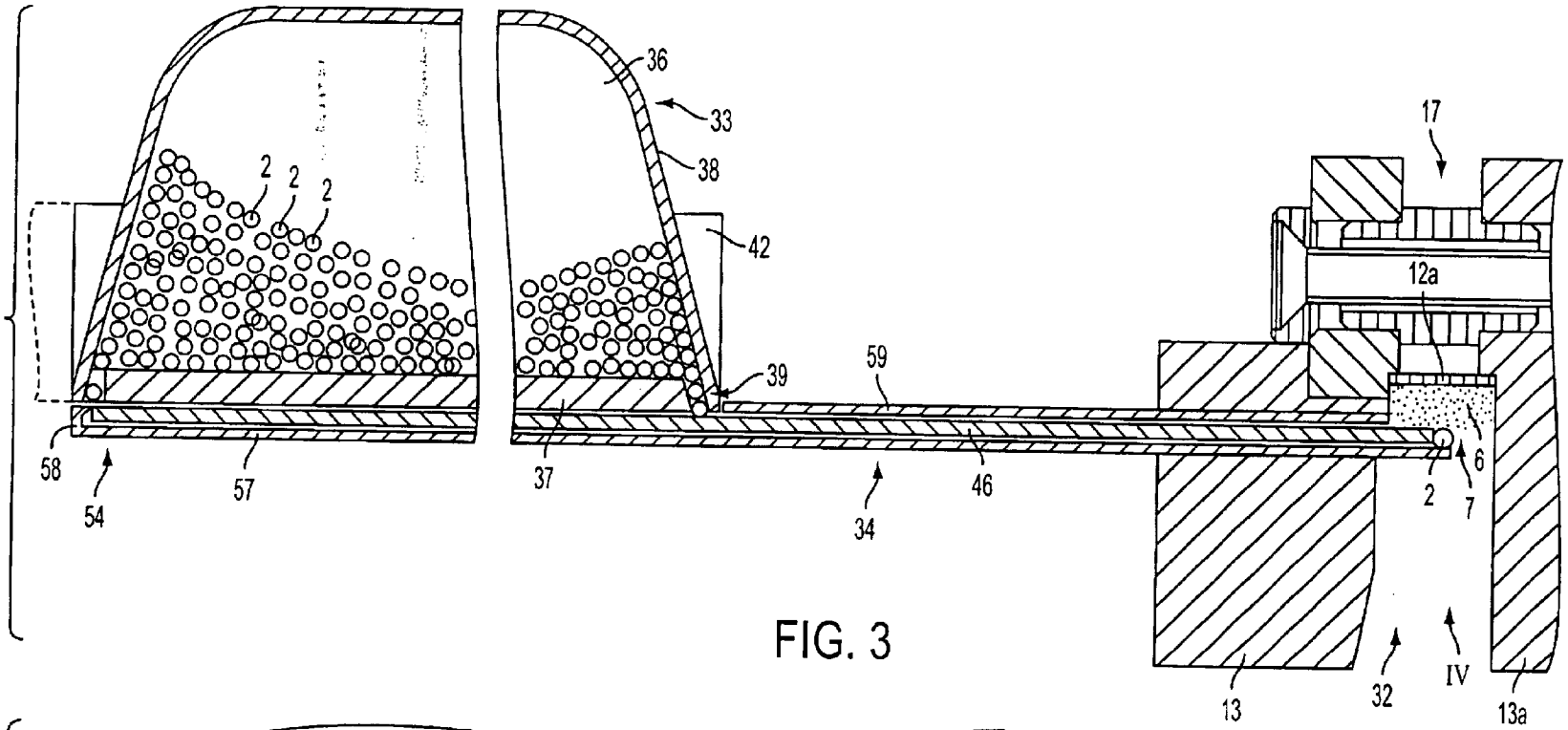
FIG. 3 is an enlarged view of a detail in the structure shown in FIG. 2.
Figure 4:
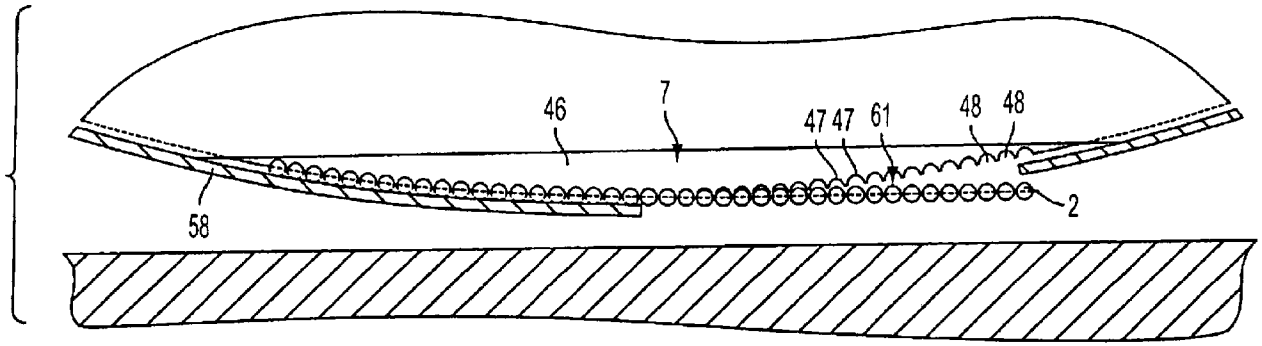
FIG. 4 is an enlarged view of a detail as seen in the direction of arrow IV shown in FIG. 3.
Figure 5:
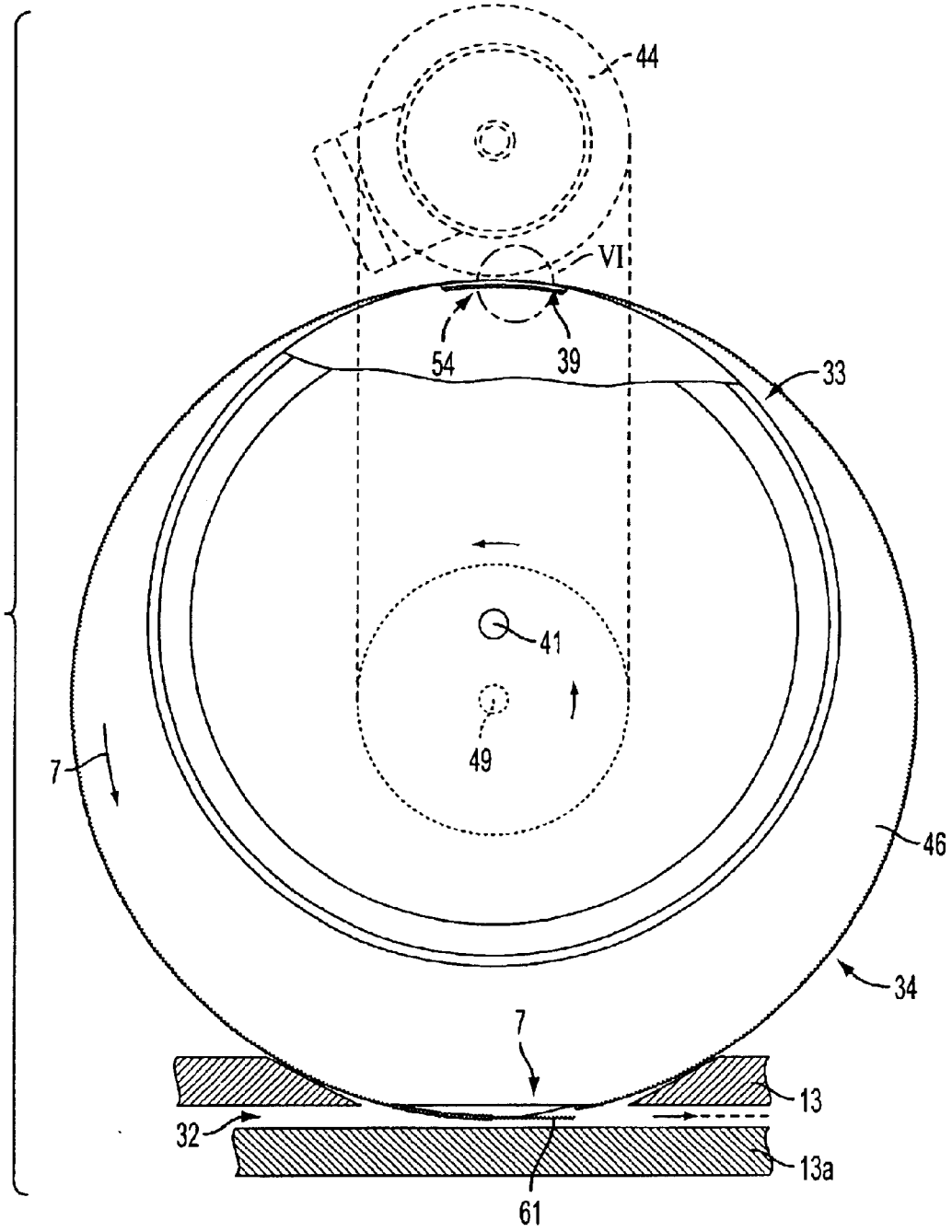
FIG. 5 is a schematic plan view of a portion of the structure which is shown in FIG. 3.
Figure 6:
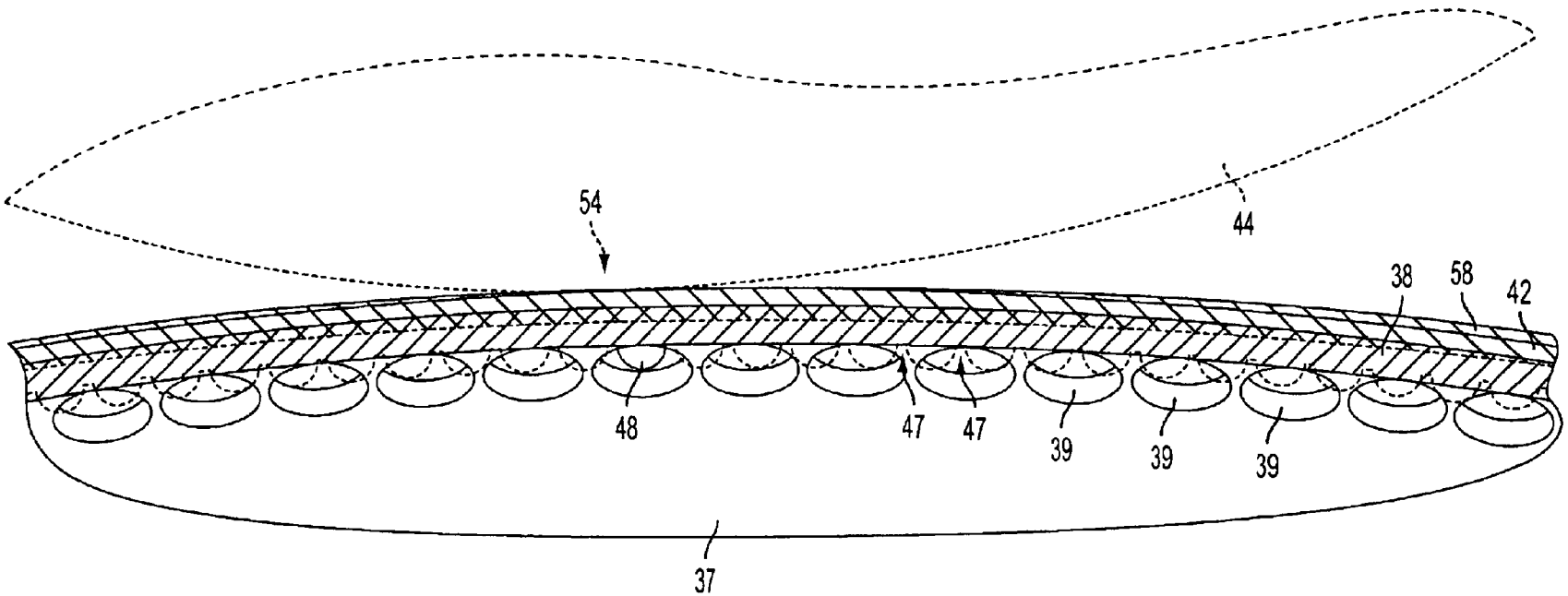
FIG. 6 is a greatly enlarged view of a detail within the phantom-line circle VI shown in FIG. 5.

The radius RZ of the disc 46 is greater than the radius RB of the bottom wall 37 of the receptacle 36 (see FIG. 2). Furthermore the axis 49 of the disc 46 is offset relative to the axis 41 of the receptacle 36 to such an extent that the teeth 47 and the tooth spaces 48 of the disc 46 register with a certain number of outlets 49 in a so-called singularizing zone 54 wherein the particles 2 can descend from the elliptical upper portions into the circular lower portions of the outlets 39 of the continuously rotating receptacle 36 and thence into the tooth spaces 48 of the disc 46. Each tooth space 48 can be dimensioned to receive a single particle 2 or two or more such particles. The particles 2 in the toth spaces 48 form the series or row 61 which is shown in FIG. 4 and which advances along the arcuate path 7 from the outlets 39 toward the portion 8 of the path for the flow 6 at the underside of the elongated lower reach 12*a* of the foraminous conveyor belt 12.

The particles 2 in the tooth spaces 48 are held against stray movements (i.e., from the prescribed path 7) by the stationary guides 57 and 58. The guide 57 is adjacent the undersides of the tooth spaces 48 along the path 7, and the guide 58 surrounds such path. The cover plate or lid 59 overlies at least those tooth spaces 48 which carry or contain particles 2 while the particles advance from the outlets 39 toward the underside of the flow 6.

When the apparatus 3 is in actual use, the speed of the receptacle 36 must be selected with a view to ensure that the centrifugal force can urge particles 2 against the inner side of the peripheral wall 38. Furthermore, the ratio of rotational speeds of the receptacle 36 and disc 46 should selected in such a way that each outlet 39 of the bottom wall 37, as well as each tooth space 48 which registers with an outlet 39, contains at least one article 2. The mutual spacing of neighboring tooth spaces 48 preferably matches (or at least closely approximates) that of the outlets 39.

The peripheral speed of that part of the receptacle 36 which defines the outlets 39 can match the speed of the teeth 47 and tooth spaces 48 of the disc 46; this ensures that, when an outlet travels through the singularizing zone 54, it assumes a position in which its circular or substantially circular discharging portion can deliver a particle 2 into the then registering tooth space 48. However, it can happen that (under certain circumstances) the transfer of particles 2 from an outlet 39 into a tooth space 48 (i.e., into the path 7) is enhanced if the speed of orbital movement of the outlets 39 departs from the speed of orbital movement of the tooth spaces 48. For example, the speed of orbital movement of the tooth spaces 48 can exceed that of the outlets 39; such selection of speeds of the receptacle 36 and of the disc 46, in conjunction with the thus selected magnitude of centrifugal force acting upon the randomly distributed particles 2 in the receptacle 36, can readily ensure a highly predictable and accurately metered transfer of particles from the receptacle into the path for the flow 6, preferably in such a way that the particles 2 are attracted to the median portion of the underside of the flow 6 (i.e., at least substantially midway between the confronting sides of the sidewalls 13, 13*a* defining the channel 32).

As concerns the reliability of transfer of particles 2 from the outlets 39 into the tooth spaces 48, it is normally desirable to select for the receptacle 36 a rotational speed exceeding that of the disc 46. In many instances, it is advisable to empirically select the optimum speeds of the receptacle 36 and the disc 46 and to thereupon set the prime mover 43 and/or the transmission 51 accordingly. For example, one can resort to empirical selection of various speeds in order to ensure that the series will contain a row 61 (FIG. 4) of equidistant particles 2 containing one or more selected additives. Neighboring particles 2 of the series or row 61 may but need not actually contact each other.

An important advantage of the improved method and apparatus is that they furnish several guarantees against any, or premature or excessive, escape of vaporizable or analogous additives from the finished rod-shaped products such as plain or filter cigarettes, cigarillos and the like. Thus, the spherical particles 2 can encapsulate the additive(s) to an extent and in a manner much more reliable than causing the additive(s) to directly contact the fibrous particles of the flow 6 and/or 10. Moreover, the particles 2 are fully embedded into the smokable material of the flows 6 and 10 which, too, reduces the likelihood of premature evaporation of volatile and like additives. Thirdly, the tubular body including the deformed layers or flows 6 and 10 is confined in the tubular envelope (such as the converted web 31 of wrapping paper) of the cigarette rod 1.

Another important advantage of the improved method and apparatus is that the particles 2 can be readily and reliably distributed longitudinally of the cigarette rod 1 so that the characteristics (such as aroma) of each of a long or short series of successive finished rod-shaped smokers' products (e.g., plain cigarettes) will be identical or will only negligibly depart from one another.

A further important advantage of the improved method and apparatus is that a highly predictable, reliable and uniform distribution of particles 2 can be arrived at in a surprisingly simple and inexpensive manner. Thus, the receptacle 36 can store a supply of randomly distributed particles 2 and the major work which is required to ensure the assembly of at least one continuous series 61 of uniformly distributed particles can be carried out by centrifugal force. The placing of the arrays of outlets 39 and tooth spaces 48 into horizontal planes also contributes to reliability and simplicity of optimum distribution of particles 2 on their way from the reservoir 52 into the path for the flows 6 and 10, i.e., into the path for the filler 11 and cigarette rod 1.

Still another important advantage of the improved method and apparatus is that all three constituents of the finished filler 11 (i.e., the flows or layers 6, 10 and the particles 2) can be maintained in optimum positions relative to each other and advanced at optimum speeds by resorting to a single and relatively simple conveyor system, namely the conveyor system employing the foraminous belt 12, the pulleys 14, the suction chamber 17, and the customary means for driving at least one of the pulleys 14. This contributes to simplicity and compactness of the apparatus 3 and is accomplished by the aforediscussed expedient of transporting the constituents of the filler 11 in suspended condition at the underside of the lower reach 12*a* of the endless foraminous belt conveyor 12. Such mode of transporting the flows 6, 10 and the series (such as 61) of particles 2 is desirable and advantageous on the additional ground that it simplifies the task of locating the particles 2 midway between the marginal portions of the flow 6. Still further, by enabling the apparatus 3 to transport the particles 2 in suspended condition, one can readily shift from deposition on the flow 6 of a continuous series 61 of particles 2 to intermittent deposition (e.g., of relatively short series of finite length) or vice versa.

The improved apparatus is susceptible of numerous additional modifications. For example, the ring-shaped array of outlets 39 can be replaced with a single elongated slot or with a series of discrete arcuate slots. In either event, a mere application of centrifugal force suffices to effect an orderly transfer of particles 2 from the pile in the receptacle 36 into the path 56, i.e., it is not necessary resort to complex, bulky and expensive mobile or other transfer devices for discrete particles 2 or for groups of two or more such particles.

An advantage of the parts 57, 58 and 59 is that they constitute very simple, inexpensive, rugged and reliable means for guiding the particles 2 on their way from the interior of the receptacle 36 to the underside of the advancing flow 6 while the latter is borne by the lower reach 12*a* of the conveyor 12. This renders it possible to transport the particles 2 in a highly inexpensive manner, i.e., without mechanically, pneumatically and/or otherwise movable transferring or transporting means.

It is often desirable to select the speed of delivery of particles 2 into the channel 32 in such a way that it at least approximates the speed of forward movement of the flow 6 with the lower reach 12*a* of the conveyor 12. This reduces the likelihood of shifting of the delivered particles 2 relative to the adjacent portions of the flow 6 and/or vice versa.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the above outlined contribution to the art of making cigarette rods and the like and, therefore, such adaptations should and are intended to be comprehended within the meaning and range of equivalence of the appended claims.

What is claimed is:

1. A method of making a smokable filler, comprising the steps of:

building a first flow of a smokable first particulate material and advancing the flow lengthwise in a predetermined direction along a predetermined path wherein the flow has a side accessible in a upstream first and downstream second portion of said path;

delivering to the side of the advancing first flow, a row of particles of a second particulate material in said first portion of said path;

applying to the side of the advancing first flow, a second flow of the smokable first particulate material overlying the particles of the second material, said applying step being carried out in said second portion of said path; and converting the first and second flows and the particles of second material into a rod-like filler wherein the second material is at least substantially surrounded by the smokable first particulate material.

2. The method of claim 1, wherein the smokable first particulate material contains comminuted tobacco.

3. The method of claim 1, wherein the second particulate material is selected from the group consisting of aromatic substances and aerosols.

4. The method of claim 1, wherein said delivering step includes introducing into said first portion of said path metered quantities of second particulate material per unit length of the rod-like filler.

5. The method of claim 1, wherein said delivering step includes admitting into said first portion of said path metered quantities of second particulate material per unit length of the first flow.

6. The method of claim 1, wherein said delivering step includes admitting into said first portion of said path metered quantities of second particulate material per unit of time.

7. The method of claim 1, wherein said delivering step includes gathering particles of second particulate material into at least one series of advancing particles and admitting into said first portion of said path successive particles of said at least one series.

8. The method of claim 1, wherein said advancing step comprises maintaining the first flow in a state of suspension by suction and wherein said side is an underside of the suspended first flow.

9. The method of claim 8, further comprising the step of attracting the particles of second material to the underside of the first flow by said suction so that the particles of second material share the movement of the first flow along said path.

10. The method of claim 1, wherein said delivering step includes delivering the row as a defined row.

11. The method of claim 1, further comprising mechanically forming particles of the second particulate material into the row.

12. The method of claim 1, wherein said delivering step includes forming the row of the second particulate material with mechanical means for forming the row.

13. A method of making a smokable filler, comprising the steps of:

building a first flow of a smokable first particulate material and advancing the flow lengthwise in a predetermined direction along a predetermined path wherein the flow has a side accessible in a upstream first and downstream second portion of said path;

delivering to the side of the advancing first flow, particles of a second particulate material in said first portion of said path;

applying to the side of the advancing first flow, a second flow of the smokable first particulate material overlying the particles of the second material, said applying step being carried out in said second portion of said path; and converting the first and second flows and the particles of second material into a rod-like filler wherein the second material is at least substantially surrounded by the smokable first particulate material, wherein said delivering step includes gathering particles of second particulate material into at least one series of advancing particles and admitting into said first portion of said path successive particles of said at least one series, and wherein said gathering step includes establishing an accumulation of particles of second material in random distribution, subjecting the accumulation to the action of centrifugal force to thus propel particles of second material into a substantially circular path, and conveying particles of second material along the substantially circular path toward and into the first portion of said predetermined path.

14. The method of claim 13, wherein said conveying step comprises maintaining the particles of second material in an at least substantially horizontal plane.

15. The method of claim 13, further comprising the step of at least intermittently replenishing the accumulation of particles of second material to thus maintain the quantity of particles of second material in the accumulation above a predetermined threshold value.

* * * * *